US006052824A

United States Patent [19]

May

[11] Patent Number: 6,052,824

[45] Date of Patent: Apr. 25, 2000

[54] ARM WARMTH RETENTION DEVICE

[75] Inventor: Beary Leon May, Whitsett, N.C.

[73] Assignee: B. L. May & Co., Inc., Sanibel, Fla.

[21] Appl. No.: 09/250,209

[22] Filed: Feb. 15, 1999

[51] Int. Cl.[7] ..... A41D 13/08

[52] U.S. Cl. ..... 2/16

[58] Field of Search ..... 2/16, 44, 45, 59, 2/125, 126; 602/62, 63; 128/846, 856; 623/58

[56] References Cited

U.S. PATENT DOCUMENTS

| | | | |
|---|---|---|---|
| D. 359,835 | 7/1995 | Hadfield . | |
| 719,650 | 2/1903 | Davis | 2/16 |
| 1,117,077 | 11/1914 | Mooney | 2/16 |
| 1,346,092 | 7/1920 | Hullinger | 623/58 |
| 1,751,872 | 3/1930 | Medaugh | 2/16 |
| 1,796,782 | 3/1931 | Gasperini . | |
| 2,045,157 | 6/1936 | Mathias | 2/16 |
| 2,528,464 | 10/1950 | Wilkerson et al. | 623/58 |
| 4,229,833 | 10/1980 | Cox et al. . | |
| 4,356,570 | 11/1982 | Vernon et al. . | |
| 4,569,087 | 2/1986 | Kerwin . | |
| 4,951,317 | 8/1990 | Gray et al. . | |
| 4,985,934 | 1/1991 | Perry . | |
| 5,035,001 | 7/1991 | Novick . | |
| 5,181,906 | 1/1993 | Bauerfeind | 602/63 |
| 5,201,075 | 4/1993 | Svetich . | |
| 5,357,633 | 10/1994 | Rael . | |
| 5,638,546 | 6/1997 | Vita | 2/16 |
| 5,815,948 | 10/1998 | Dzielak | 2/22 |

*Primary Examiner*—John J. Calvert
*Assistant Examiner*—Tejash Patel
*Attorney, Agent, or Firm*—Alston & Bird LLP

[57] ABSTRACT

A device for retaining warmth in the arm of a wearer while enabling substantially unrestricted movement is described. The device includes a tubular elastic sleeve for encirclingly covering an arm and shoulder of a wearer, which terminates in a first generally circular open end for positioning proximate the wearer's shoulder. The device has a first section for covering the underside of a wearer's arm and the front side of a wearer's arm and shoulder and a second section for covering the outer side of a wearer's arm and shoulder, with the first section terminating in a substantially U-shaped edge for conforming to the shape of a wearer's armpit. The device includes an elastic strap member which extends outwardly from the sleeve to form an elongate loop for securing the device to a wearer's body. The elastic strap is desirably lubricated to reduce friction between it and a wearer's body. In use, the sleeve is positioned over the wearer's arm to be warmed, the strap is positioned so that it extends across the back of the wearer's upper torso, and around the front of the wearer's opposite arm. The straps are preferably criss-crossed as they are passed over the wearer's back, to form an X-shaped configuration across the wearer's back. The device is designed to provide and retain warmth in the wearer's arm and shoulder without restricting wearer movements, such that the device can be worn throughout participation in athletic activities. The device may also include a second sleeve for encircling the second arm of the wearer as well.

24 Claims, 2 Drawing Sheets

ARM WARMTH RETENTION DEVICE

BACKGROUND OF THE INVENTION

1. Field of the Invention

The invention generally relates to a sleeve for use in retaining warmth in a wearer's arm and shoulder. More specifically, the invention relates to an arm warmth retaining sleeve providing improved wearer comfort, particularly when worn while the wearer engages in athletic activities.

2. Description of the Prior Art

It has been widely recognized that warm muscles generally perform better than cold ones; therefore, athletes typically "warm up" prior to engaging in their respective athletic activities. For example, basketball players generally shoot a number of baskets and dribble the basketball around for a period of time prior to the start of a game, in order to loosen and warm their muscles prior to exerting them maximally during game play. Similarly baseball players, and particularly pitchers, throw a number of balls prior to their entry into the game in order to warm up their arm muscles prior to play. Not only do the warmed-up muscles perform better during the activity than cold ones, but the thus-warmed muscles have a reduced tendency to become strained or otherwise injured. For this reason, when baseball pitchers come off the mound, the first thing they typically do is insert their pitching arm within the sleeve of a jacket, in order that their muscles will stay loose and warm for the next inning. Such wear is only suitable while the pitcher is off the field, however, because the wearing of apparel obscuring the uniform is prohibited by most sports regulating bodies, and because the free sleeve and remainder of the jacket would interfere with the player's ability to move properly during game play. Also, this method does not prevent cooling of the muscles while the player is on the field which can result from time gaps between uses of the muscles and from cool environmental temperatures. While fully donning the jacket would overcome some of the above-stated problems, it is often objectionable to do so because the jacket can restrict the wearer's freedom of movement and can contribute to overheating of the player.

Attempts have been made to provide devices which cover only the arm of a pitcher, in order to maintain the warmth of the arm throughout a game. For example, U.S. Pat. No. 4,229,833 to Cox et al. describes a warm-up sleeve for athletes which is designed to cover the throwing arm and shoulder of a wearer. The sleeve is apparently loose-fitting and includes a separate elastic wrist cuff portion and a strap arrangement for securing the sleeve to a wearer's body. Two strap arrangements are described, each of which extends from the lateral edges of the shoulder portion of the sleeve: in the first, the strap is designed to extend from the shoulder around the opposite side of the wearer's neck, while in the second, the strap is designed to extend from the outer edge(s) of the shoulder portion of the sleeve, around the front and rear of the wearer's torso and beneath the wearer's opposite arm. Although this sleeve would therefore be more efficient than a half-worn jacket, the straps tend to restrict full wearer movement and have a tendency to chafe and bind the regions of the wearer's body which they cover. This can in turn lead to unconscious restriction of movement by the wearer in order to minimize the chafing effect. In addition, the cuff can have a tendency to irritate the wearer's wrist region, since it tends to slide over that region as the wearer's arm is alternately bent and extended as during the pitching motion.

Other attempts at providing arm warming sleeves are described in U.S. Pat. No. 4,356,570 to Vernon et al, U.S. Pat. No. 4,569,087 to Kerwin, U.S. Pat. No. 4,985,934 to Perry, U.S. Pat. No. Des. 359,835 to Hadfield, and U.S. Pat. No. 4,951,317 to Gray et al. The Vernon patent describes a garment having a cuffed sleeve for covering a wearer's arm and a skirt attached to the sleeve for covering the deltoid, pectoral and tarus major and minor muscles adjacent the wearer's throwing arm. The skirt is secured to the outer surface of a wearer's uniform for retention thereon when the sleeve is positioned on the wearer's arm; for example, it is described that hook type fasteners can be used on the underside of the skirt which are adapted to secure with the knit fabric typically used to form wearers' uniforms. Alternatively, it is described that mating loop fasteners can be provided on the exterior of the wearer's uniform for mating with the hook fasteners on the skirt. As will be apparent, however, the use of such fasteners thus requires the alteration of the exterior of a wearer's uniform by applying loop fasteners thereto (which is prohibited in many athletic leagues), or the garment will likely suffer damage when the hook fasteners are secured directly to the garment fabric itself.

The Kerwin patent describes a similar one-sleeved garment including a limb enclosing means, a harness and a yoke which extends around the base of a wearer's neck. The sleeve terminates in a wrist cuff, and the yoke extends rather closely around the wearer's neck, which can restrict the wearer's movements. As a result, the patent describes that the garment is removed when the athlete is called upon to perform.

The patent to Perry describes a sports sleeve in the form of a half jacket. In addition to covering the wearer's throwing arm and shoulder, the device also covers the adjacent half of the wearer's upper torso. The device includes a cuff about the free end of the sleeve, and is secured to the wearer's body by way of first and second straps. The first strap extends from a center region of the front torso covering portion, over the opposite shoulder of the wearer, and to an upper region of the rear torso covering portion, while a second single or strap pair extends horizontally from a center region of the front torso covering portion to a center region of the rear torso covering portion. Like the other prior art articles, the Perry garment is designed to be removed prior to game play.

The Hadfield patent illustrates a baseball pitcher warming sleeve in the form of an elongated tubular sleeve with a cinchable strap secured to the upper opening of the sleeve, and a cuff portion attached to the lower end of the sleeve. Because the cinchable strap extends circumferentially about the wearer's arm, it would need to be cinched tightly in order to be retained on a wearer's arm during the execution of strong motions, which would therefore render it unsuitable for use during actual game play of most sports activities.

The patent to Gray et al describes an athletic sleeve for protecting an arm or a leg of a wearer. The sleeve is in the form of an elongated tube, and includes mating fasteners along its exterior which enable the cylindrical dimension of the sleeve to be reduced around the limb after application of the sleeve. The device is illustrated as covering only the arm of a wearer, and therefore would not sufficiently warm the shoulder region of a wearer in a manner required for many applications. Furthermore, the device would tend to restrict strong movements of the wearer which require the bulging and retracting of relatively large muscles, such as the biceps, since the cylindrical dimension of the device is tightened about the wearer's arm. Therefore, the device would be ineffective for use in sports where shoulder warming is desired, and would be unsuitable for use during actual game play.

SUMMARY OF THE INVENTION

With the foregoing in mind, it is an object of the present invention to provide an arm warming device which enables retention of suitable warmth in the arm and shoulder of a wearer, without unduly restricting the movements thereof.

It is also an object of the present invention to provide an arm warming sleeve which can be worn continuously throughout game play, because it is not restrictive and because it does not interfere with the appearance of a wearer's uniform.

These and other objects are met through the provision of an arm warming device having an elongated sleeve which is preferably elastic, and which is adapted to cover the arm and shoulder of a wearer's arm, and a unique strap structure for securing the device on the wearer's body without restricting the wearer's motions. Preferably, the sleeve is formed to be substantially entirely elastic, such as by forming it from a continuous piece of elastic material which is seamed together to form a tubular structure. Alternatively, the sleeve could be constructed as a seamless tube, such as by circularly knitting the tubular sleeve in the manner used to make stockings and other types of seamless tubular articles. In either case, the sleeve is sized to extend substantially over the entire region of a wearer's arm which is to be warmed.

For most warming applications such as in sports where the throwing muscles of the arm are to be warmed, the sleeve will be sized to extend substantially from over the top of the wearer's shoulder down to at least the forearm, preferably terminating proximate the wearer's wrist. Because the sleeve is elastic, it fits closely and comfortably about the wearer's arm; however, the material used and sleeve dimensions are selected so that the sleeve closely and comfortably fits the wearer's arm without compressing or otherwise binding it. In this way, the need for an extraneous cuff portion, such as those required by the prior art sleeve constructions, is obviated. Furthermore, the use of an elastic material to form the sleeve enables the structure to conform more readily to the curve of the shoulder of a wearer's body. In any event, the material from which the sleeve is formed is selected to provide the amount of insulation desired to achieve the desired amount of arm warming and heat retention.

The sleeve includes a first section for covering the underside of a wearer's arm and the front of a wearer's arm and shoulder and a second section for covering the back side of a wearer's arm and the wearer's shoulder. The first section, which generally comprises greater than half of the sleeve circumference, terminates at its upper end in a generally U-shaped edge for positioning proximate a wearer's armpit, to conform to the shape thereof, and so that the sleeve extends along the juncture of the shoulder with the upper torso without interfering with the movement of the arm and shoulder. (While referred to as "sections" for purposes of orientation and description of the device, the first and second sections are desirably integrally formed, as noted above, in order to minimize the number of seams which might irritate the wearer's skin and to facilitate manufacture.)

The sleeve further includes an elastic strap member in the form of an elongate loop which is designed to extend substantially continuously along the generally U-shaped edge of the first sleeve section, and outwardly from the upper end of the sleeve (i.e. that which is designed to be positioned proximate the shoulder when the device is worn), across the back of the wearer, around the front of the wearer's opposite shoulder. This elongate loop preferably extends outwardly in a direction substantially parallel with the axis of the tubular sleeve. In a preferred form of the invention, the generally U-shaped edge of the first sleeve section includes a channel extending substantially continuously along the generally U-shaped end of the first sleeve section, and the elastic strap member extends through the channel in the form of a drawstring. Also in one form of the invention, the elastic strap member is in the form of an endless ring, which can be formed by securing the ends together of a piece of elastic shock cord, for example.

In a preferred form of the invention, the elastic strap is adapted to minimize friction with a wearer's body. In a particularly preferred form of the invention, the strap is lubricated such as by a silicone coating, to reduce friction and potential chafing. Also, the strap member is selected from a material which does not have a tendency to cut into or bind a wearer; it has been found that an elastic shock cord having a circular cross-section and diameter of less than about 5 centimeters (and preferably about 1 centimeter) performs well in the invention. However, it is to be noted that other elastic strap materials can be used within the scope of the invention.

In operation, a wearer positions his arm to be warmed (typically the throwing arm for most sports) within the sleeve such that a lower end of the sleeve terminates proximate the wearer's forearm or wrist and the upper end extends over the top of the wearer's shoulder, with the elastic strap member being located proximate the back of his upper torso. The wearer then extends the strap across his back and inserts his opposite arm through the looped end of the elastic strap member, so that the strap extends from the sleeve, across his back, around the front of his shoulder, and back to the sleeve. In a particularly preferred form of the invention, the strap is criss-crossed as it extends across the wearer's back, so as to form an X configuration thereacross. This X can be formed by the wearer as he dons the device, or it can be preformed by the strap structure itself, such as by stitching or otherwise securing central portions of the strap member together such that an X is formed by the strap at all times. Although the donning process has been described as including the initial step of placing the sleeve on the arm to be warmed, it is noted that the process can be performed in the reverse order, with the choice of order being based on the specific preferences of the wearer as well as such factors as the relative elasticities of the sleeve and the elastic strap member.

In an alternative embodiment of the invention, two sleeves are provided on the elastic strap member, so that each of a wearer's two arms can be covered.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
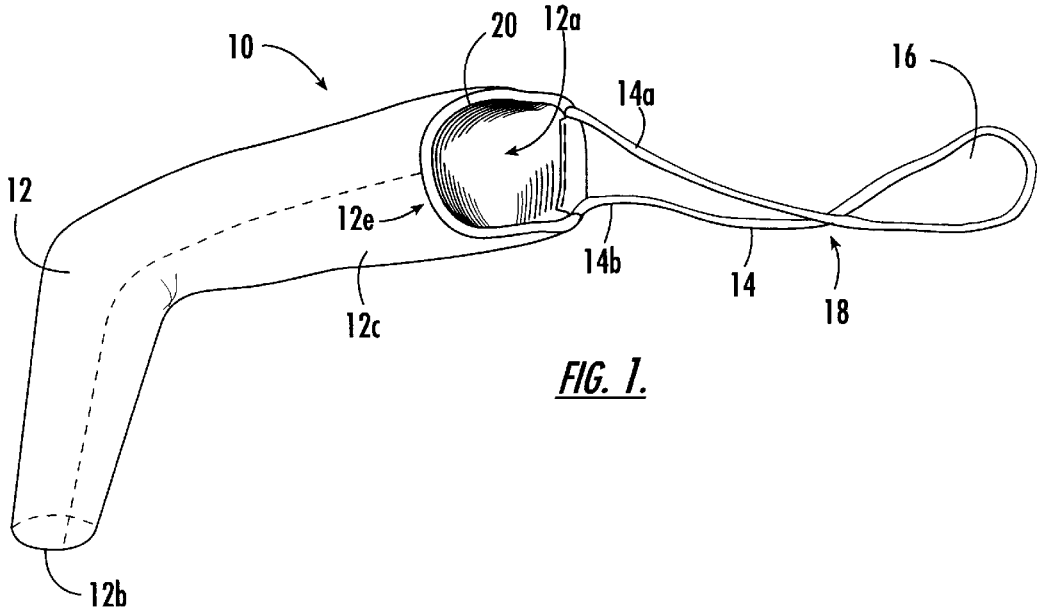
FIG. 1 is a perspective view of a device according to the instant invention, with the elastic strap shown in its criss-crossed position as it would desirably be positioned on a wearer's body.

With reference to the drawings, FIG. 1 is a perspective view of an arm warming device according to the instant invention, shown generally at 10, as it appears prior to being donned by a wearer. The device 10 includes a tubular sleeve 12 having an upper open end 12*a* and a lower open end 12*b*. As shown more clearly in FIG. 2, the upper end 12*a* is adapted to receive a shoulder of a wearer of the device, while the lower end is adapted to terminate proximate a lower end of a wearer's arm, preferably proximate the forearm or wrist region of the wearer. The sleeve 12 is desirably elastic, so as to form fit with the wearer's arm, while enabling unhindered expansion and retraction of the wearer's muscles, such as occurs through the flexing of the muscles during participation in athletic activities. In this way, the sleeve can be retained about a wearer's forearm or wrist without the need for a supplemental cuff. In one form of the invention, the sleeve 12 is tapered inwardly from the upper shoulder covering end to the lower arm covering end, in order to closely conform to the shape of a wearer's arm.

The sleeve 12 is preferably formed from a single continuous piece of elastic material; this can be performed by providing a piece of material which is sewn or otherwise secured together to form a tubular sleeve, by circularly knitting a tubular structure, or any other method which can be used to produce an elastic sleeve having a size approximating that of a human arm. As noted, the material used to form the sleeve is desirably sufficiently elastic to allow unrestricted motion by a wearer, yet it provides a close fit, so as to not flap loosely where it might interfere with a wearer's motions. In a preferred form of the invention, the material is spandex, which has been found to provide good insulating properties to the wearer's arm while enabling unhindered motion. Alternatively, other types of materials (e.g. cotton, polypropylene, nylon, or the like, or blends thereof) can be selected within the scope of the instant invention to provide good insulation characteristics to the wearer's body while enabling freedom of movement by the wearer. Furthermore, the fabric can be selected to provide other functional characteristics to the device, such as the ability to wick moisture away from the wearer's body. In addition, the weight, thickness and other characteristics of the material can be selected to provide the required amount of insulation desired by the wearer. For example, it has been found that knitted spandex fabric of a weight like that used in bathing suits and athletic apparel performs will in the invention.

The sleeve 12 includes a first section 12*c* for covering the underside of a wearer's arm and the front of a wearer's arm and shoulder and a second section 12*d* for covering the back side of a wearer's arm and shoulder. The first section 12*c* terminates in a substantially U-shaped edge 12*e*, which is adapted to follow the contours of a wearer's armpit region when the device is worn so that the sleeve extends along the juncture of the shoulder with the upper torso without interfering with the movement of the arm and shoulder. The second section preferably has a length from the sleeve upper open end 12*a* to the lower open end 12*b* which is greater than the length of the first sleeve section, so that the second section has a length sufficient to cover at least a portion of the back of a wearer's shoulder.

The device 10 also includes an elastic strap member 14 in the form of an elongate loop 16. The strap member 14 is desirably secured to the sleeve such that it extends along the substantially U-shaped edge of the first sleeve section, with the loop extending outwardly from the first sleeve section in a direction substantially parallel to the sleeve axis. In this way, the strap member defines first and second legs 14*a*, 14*b* which are spaced apart along the circumference of the tubular sleeve 12, and the second sleeve section extends between the two legs 14*a*, 14*b* such that it will naturally assume a position covering the outer side of a wearer's arm and shoulder when the device is properly donned.

Figure 2:
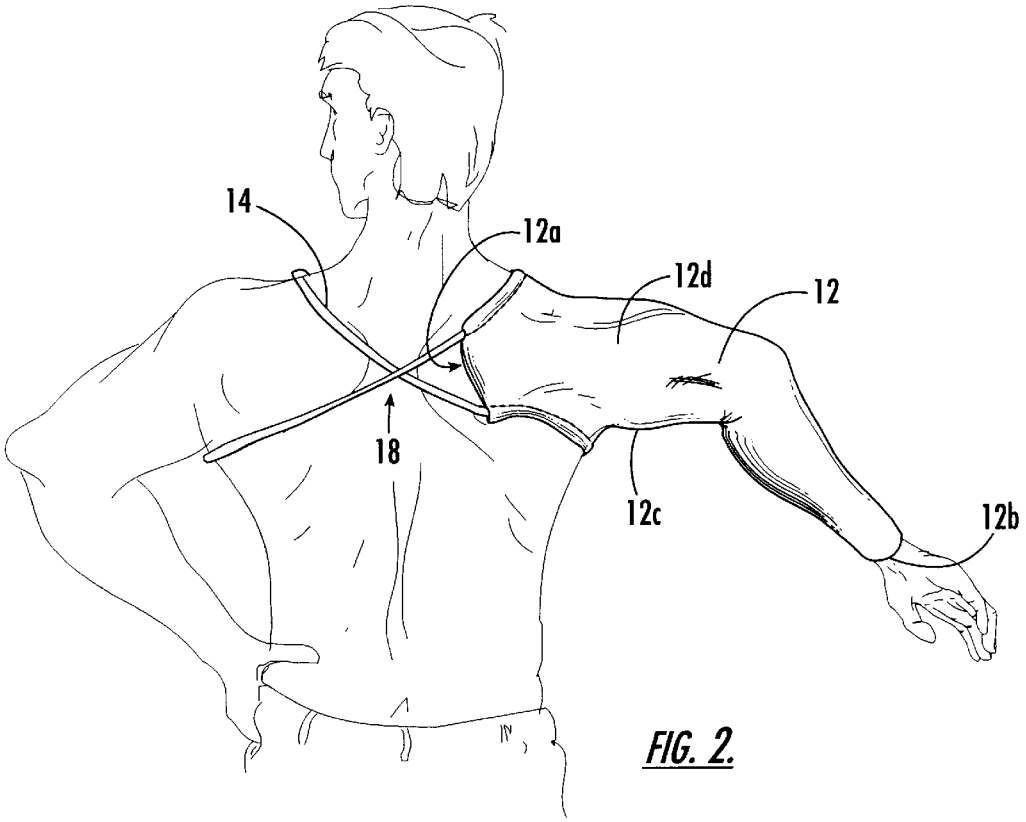
FIG. 2 is a rear environmental view of the device shown in FIG. 1, illustrating how the device appears when worn by a wearer viewed from the rear.
Figure 3:
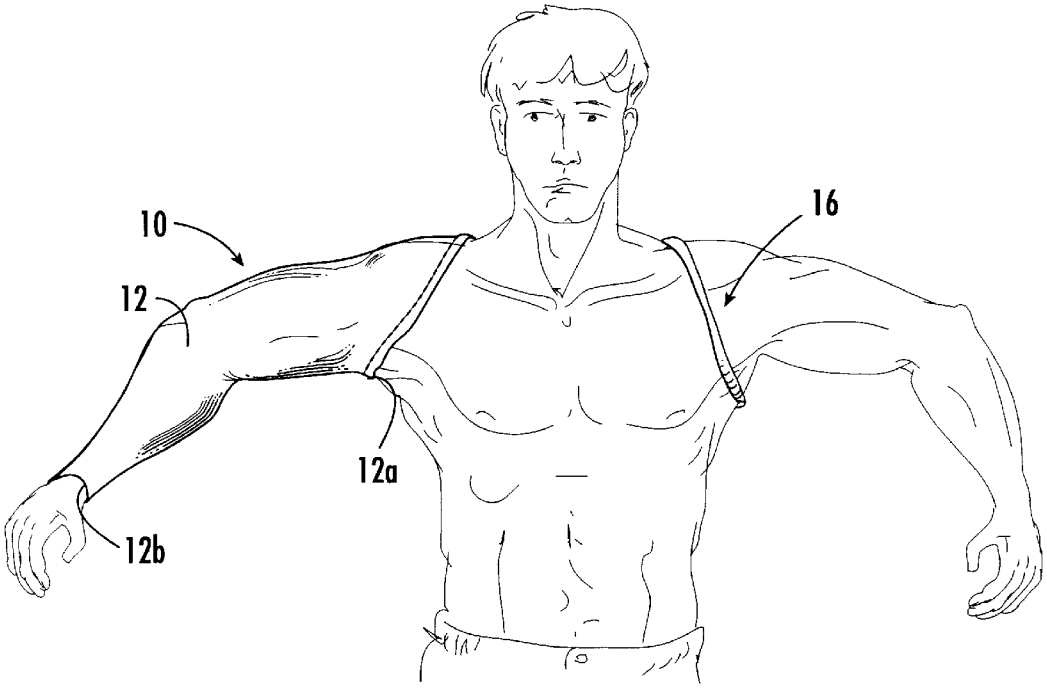
FIG. 3 is a front environmental view of the person of FIG. 2 wearing the device, illustrating how the device appears when viewed from the front of the wearer.

In one aspect of the invention, the first section of the sleeve includes a channel 20 extending substantially continuously along its first end 12*e*. The channel may be formed in any suitable manner, such as by folding back the fabric upon itself and seaming, to form a finished hemmed edge, as is well known. The hemmed edge preferably extends around the entire circumferential extent of the upper open end 12*a*. In this form of the invention, the elastic strap member 14 is desirably provided in the form of an endless ring structure (such as by securing the elastic band ends together via metal fasteners, or knitting a strip of material together to form a ring shape). This ring-shaped elastic strap member is positioned within the channel 20, passing through the channel and emerging at two spaced locations. The fabric is freely movable around the strap member and can be gathered in the form of a drawstring. Because the elastic strap member 14 is not directly secured to the shoulder covering portion of the device (like the prior art devices), the wearer's motions are not restricted or hindered like with those prior art structures. Preferably the strap member passes through the channel 20 a distance greater than half of the circumferential extent of the channel, and preferably, about 240 to 270 degrees around the circumference of the sleeve upper end 12*a*. In the embodiment shown, the strap passes through the channel over at least about 240 degrees of the circumference of the sleeve upper end 12*a*. It emerges at two locations which, when worn, may be positioned adjacent the top of the shoulder and beneath the shoulder adjacent the armpit as shown in FIG. 2. The elastic strap member 20 holds the sleeve comfortably and snugly adjacent the front side of the arm as shown in FIG. 3.

The strap member 14 can be formed from more than one piece of material, although the use of a single piece of elastic material is preferred. For example, the strap member could be formed as two pieces with a plurality of fasteners for securing the pieces together at different locations, to thereby enable adjustment of the length of the strap member. As noted, the elastic strap member 14 is secured to the sleeve 12 with the strap member legs 14*a*, 14*b* being spaced apart from each other along the circumference of the sleeve upper end 12*a*. In this way, the elongated loop 16 is relatively open, in order that it can readily receive the arm of the wearer opposite that wearing the sleeve 12, to secure the device 10 to the wearer's body. The elastic strap member is designed to criss-cross across the back of the wearer when the device is worn to form an X-shaped configuration, as shown generally at 18. This criss-crossing can be performed by the wearer during the donning of the device 10, or alternatively, central portions of the elastic strap member can be secured together during the manufacture of the device, such as by stitching or otherwise securing central portions of the elastic strap member together to form the X-shaped configuration. It has been found that this criss-crossed orientation of the elastic strap member 14 provides good securement of the device to a wearer's body, while allowing free unrestricted motion of the wearer.

The elastic strap member 14 is produced from a material selected to minimize friction and discomfort when positioned adjacent a wearer's skin. It has been found that relatively narrow and/or rounded elastic bands perform well in the invention, as they have less of a tendency to grab onto the body hair of a wearer. For example, it has been found that an elastic shock cord having a round cross-section and a diameter of less than about five centimeters (and preferably about one centimeter) performs well in the invention. However, other forms of strap member can be used within the scope of the invention. In a particularly preferred form of the invention, the elastic strap member is lubricated in order to reduce friction between it and the wearer's body when the device is worn. For example, it has been found that by coating the elastic strap member with a silicone coating or other form of lubricant, the strap member is enabled to slide comfortably across a wearer's body without causing discomfort or grabbing the body hair of the wearer.

In operation, a wearer inserts the arm to be warmed within the sleeve 12, such that the upper end 12*a* of the sleeve receives the shoulder of the wearer, while the lower end 12*b* terminates proximate a lower end of the arm of the wearer. In order to provide optimal warmth to the wearer's arm, the lower end 12*b* of the sleeve 12 is desirably positioned so that it terminates proximate the forearm or wrist region of the wearer. The elastic strap member 14 is then criss-crossed (if central portions of the strap member have not already been secured to form an X-shaped configuration), and the opposite arm inserted through the loop 16. As noted above, the order in which the elements of the device are donned can be varied according to what the wearer finds to be the easiest method for himself.

Figure 4:
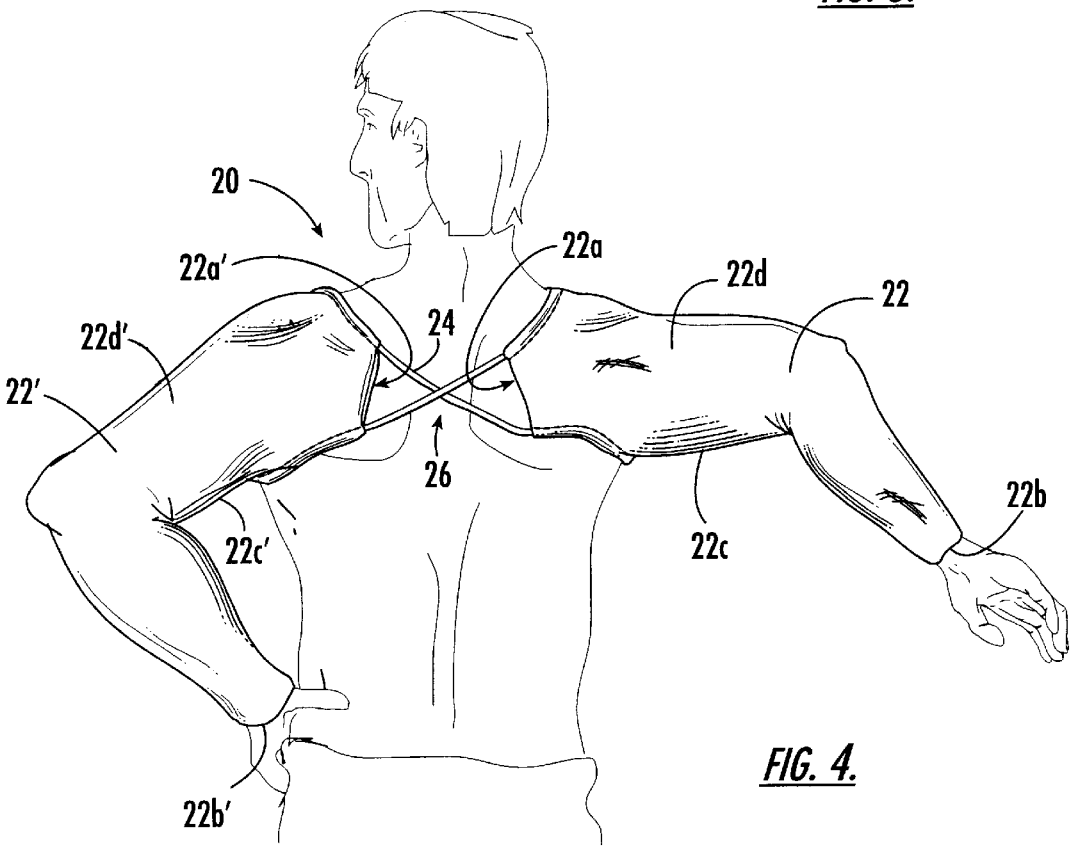
FIG. 4 is a rear environmental view of an alternative embodiment of the invention having sleeves for covering each of the wearer's two arms.

FIG. 4 illustrates an alternative embodiment of the invention, shown generally at 20, having two sleeve members 22, 22', one for covering each of the wearer's arms. The sleeve members 22, 22' are desirably made in substantially the same manner as described above with respect to the other embodiments of the invention, so that each includes a first section 22*c*, 22*c'* for covering the underside of a wearer's arm and the front of a wearer's arm and shoulder and a second section 22*d*, 22*d'* for covering the backside of a wearer's arm and shoulder. The first section 22*c*, 22*c'* of each sleeve 22, 22' terminates in a substantially U-shaped edge 22*e*, 22*e'*, which is adapted to follow the contours of a wearer's armpit region when the device is worn so that the sleeve extends along the juncture of the shoulder with the upper torso without interfering with the movement of the arm and shoulder. The second section 22*d*, 22*d'* of each desirably has a length from the sleeve upper open end 22*a*, 22*a'* to the lower open end 22*b*, 22*b'* which is greater than the length of the first sleeve section, so that the second section has a length which is sufficient to cover at least a portion of the back of a wearer's shoulder.

The device 20 also includes an elastic strap member 24, in the form of an elongate loop, and it is desirably secured to the sleeves 22, 22' such that it extends along the substantially U-shaped edge 22*e*, 22*e'* of each of the first sleeve sections to extend outwardly from each of the first sleeve sections in a direction substantially parallel to each of the sleeve axes. In this way, each of the sleeves 22, 22' can be oriented along opposite portions of the elastic strap member, to extend outwardly therefrom. In a preferred form of this embodiment of the invention, the sleeves are secured to the elastic strap member 24 such that when the elastic strap member is in an uncontorted condition, the first section 22*c* of the first sleeve 22 and the second section 22*d'* of the second sleeve 22' are facing a first direction, while the second section 22*d* of the first sleeve 22 and the first section 22*c'* of the second sleeve 22' each face the opposite direction. In this way, the elastic strap member can be criss-crossed across the water's back (as at 26) in the manner described above, and each of the sleeve members will be properly oriented on the wearer's body, in the manner shown in FIG. 4. The elastic strap member 24 is desirably formed in the same manner as described above with respect to the other embodiments. Likewise, the same materials can be used to form the elastic strap member and the elastic sleeve members as described above.

The device provides good warmth and warmth retention to a wearer's arm and shoulder, yet does not undesirably restrict his motion. Therefore, unlike the prior art devices, the device of the instant invention can be worn throughout participation in the actual events for which the muscles will be used, rather than just when the wearer is on the sidelines. In addition, although the device has been discussed specifically in connection with sports such as baseball, it is to be noted that it would be useful in virtually any activity where arm and shoulder warmth would be of an advantage to a person. For example, the device could be used in sports such as tennis, squash, racquetball, bowling, cricket, lacrosse, etc. Also, because the device can be relatively inconspicuously worn, it can be worn with most uniforms without affecting their overall appearance. Alternatively, the device can be used in medical, convalescent or therapeutic environments, such as to provide warmth and support following a rotator cuff injury or prevent muscles jostling following surgery on the flexor or extension muscles. Further-more, the sleeves can be used by workers such as baggage or box handlers, postal workers, factory workers, and the like, where it would enhance employee safety and comfort to have warmed arm and shoulder muscles.

As a further alternative, the sleeve could be made from a waterproof material (such as neoprene rubber or types used to manufacture divers' wetsuits), and used by water polo players or players of other similar types of water sports. In this way, the athletes' play can be enhanced because their muscles will remain warm and limber, and each team can wear differently colored or ornamented sleeves from the other team, in order that members of each team can readily be distinguished from each other.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An arm warming device adapted to be worn on one arm of a wearer comprising:

a tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder, said first section having a first edge which is adapted to follow the contour of a wearer's armpit, a channel extending along said first edge of said first section of said sleeve, and said second section of said sleeve having a first edge which is adapted to be positioned proximate a wearer's shoulder; and an elastic strap member positioned within said channel and extending substantially along said first edge of said first section of the sleeve and outwardly from between said first and second sections of the sleeve in the form of an elongate loop, said loop being sized to extend across a wearer's back and around the front of the wearer's arm opposite that wearing the sleeve, to secure the device to a wearer's body.

2. A device according to claim 1, wherein said second section has a length from said sleeve upper open end to said lower open end which is greater than the length of said first section from said sleeve upper open end to the sleeve lower end, so as to enable said second section of said sleeve to cover the top of a wearer's shoulder.

3. A device according to claim 1, wherein said elastic strap member extends through the channel over at least about 240 degrees of the circumference of the sleeve upper end.

4. A device according to claim 1, wherein said elastic strap member has a substantially circular cross-section and a cross-sectional diameter of less than about 5 centimeters.

5. A device according to claim 1, wherein said sleeve comprises an elastic material.

6. A device according to claim 5, wherein said sleeve is formed from a substantially continuous piece of elastic material.

7. A device according to claim 6, wherein said substantially continuous piece of elastic material terminates at said lower end to form a second generally circular open end to define a substantially cuffless wrist portion for the sleeve.

8. A device according to claim 1, wherein the elastic strap member criss-crosses over itself to form an X-shaped configuration, and central portions of said strap member are secured together such that the strap member is secured in the X-shaped configuration.

9. An arm warming device adapted to be worn on one arm of a wearer comprising:

a tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder, said first section having a first edge which is adapted to follow the contour of a wearer's armpit and said second section of said sleeve having a first edge which is adapted to be positioned proximate a wearer's shoulder; and an elastic strap member extending substantially along said first edge of said first section of the sleeve and outwardly from between said first and second sections of the sleeve in the form of an elongate loop, said loop being sized to extend across a wearer's back and around the front of the wearer's arm opposite that wearing the sleeve, to secure the device to a wearer's body, wherein said elastic strap member includes a lubricant to reduce friction between the strap member and a wearer when the device is worn.

10. A device according to claim 9, wherein said lubricant comprises a silicone coating.

11. An arm warming device adapted to be worn on one arm of a wearer comprising:

a first tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder, said first section having a first edge which is adapted to follow the contour of a wearer's armpit and said second section of said sleeve having a first edge which is adapted to be positioned proximate a wearer's shoulder; and an elastic strap member extending substantially along said first edge of said first section of the sleeve and outwardly from between said first and second sections of the sleeve in the form of an elongate loop, said loop being sized to extend across a wearer's back and around the front of the wearer's arm opposite that wearing the sleeve, to secure the device to a wearer's body, and further comprising a second tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder, said first section having a first edge which is adapted to follow the contour of a wearer's armpit and said second section of said sleeve having a first edge which is adapted to be positioned proximate a wearer's shoulder, wherein said loop formed by said elastic strap member extends substantially along the first edge of said first section of said second tubular sleeve.

12. An arm warming device adapted to be worn on one arm of a wearer comprising:

a first tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder, said first section having a first edge which is adapted to follow the contour of a wearer's armpit and said second section of said sleeve having a first edge which is adapted to be positioned proximate a wearer's shoulder; and an elastic strap member extending substantially along said first edge of said first section of the sleeve and outwardly from between said first and second sections of the sleeve in the form of an elongate loop, said loop being sized to extend across a wearer's back and around the front of the wearer's arm opposite that wearing the sleeve, to secure the device to a wearer's body, and further comprising a second tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder, said first section having a first edge which is adapted to follow the contour of a wearer's armpit and said second section of said sleeve having a first edge which is adapted to be positioned proximate a wearer's shoulder, wherein said elastic strap member and first and second tubular sleeves are secured together such that the first section of said first tubular sleeve and the second section of said tubular sleeve face substantially the same direction when said elastic strap member is in a substantially uncontorted configuration.

13. An arm warming device comprising an elastic tubular sleeve extending substantially continuously between a first generally circular open end for receiving a shoulder of a wearer and a second generally circular open end for receiving a wrist region of a wearer, said sleeve defining a first section for covering the underside of a wearer's arm from the armpit to substantially the forearm and the front of the wearer's arm and shoulder and a second section for covering the back side of a wearer's arm and a wearer's shoulder, said first section having a substantially U-shaped edge for positioning proximate a wearer's armpit and extending substantially along the juncture of a wearer's shoulder and upper torso; and an elastic strap member extending substantially continuously along said U-shaped edge and outwardly from said sleeve in the form of an elongate loop, said loop including a first leg extending outwardly from a first side of said first sleeve section and a second leg extending outwardly from a second side of said first sleeve section such that said second sleeve section extends between said first and second legs of said strap member and said first and second legs are spaced apart along the circumference of said tubular sleeve.

14. A device according to claim 13, wherein said first section of said sleeve includes a channel extending substantially continuously along said substantially U-shaped edge of said first section of said sleeve and said elastic strap member is positioned within the channel to form a drawstring therein.

15. A device according to claim 13, wherein said elastic strap member is adapted to form an X-shaped configuration across a wearer's back when the sleeve is positioned on a first arm of the wearer and the second arm of the wearer is inserted through the loop formed by the elastic strap member.

16. A device according to claim 15, wherein central portions of the elastic strap member are secured together in a criss-crossed orientation to produce said X-shaped configuration adapted to be positioned across a wearer's back when the device is worn.

17. A device according to claim 13, wherein said elastic strap member includes a lubricant for reducing friction between the strap member and a wearer when the device is worn.

18. An arm warming device adapted to be worn on one arm of a wearer comprising:

a first tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder;

a channel formed in said tubular sleeve along said upper open end; and an endless elastic strap member extending through said channel and emerging from the channel at two spaced locations along the circumferential extent of said upper open end, portions of the strap member extending outwardly therefrom in the form of an elongate loop sized to extend across a wearer's back and around the front of the wearer's arm opposite that wearing the sleeve to secure the device to a wearer's body.

19. A device according to claim 18, wherein said strap member passes through the channel a distance greater than half of the circumferential extent of said upper open end.

20. A device according to claim 18, wherein said strap member passes through the channel about 240 degrees around the circumferential extent of the sleeve upper open end.

21. A device according to claim 18, wherein said strap member comprises an elastic shock cord of round cross section, and said cord is freely moveable within said channel.

22. An arm warming device adapted to be worn on one arm of a wearer comprising:

a first tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder;

a channel formed in said tubular sleeve along said upper open end; and an endless elastic strap member extending through said channel and emerging from the channel at two spaced locations along the circumferential extent of said upper open end, portions of the strap member extending outwardly therefrom in the form of an elongate loop sized to extend across a wearer's back and around the front of the wearer's arm opposite that wearing the sleeve to secure the device to a wearer's body, wherein the elastic strap member criss-crosses over itself to form an X-shaped configuration across the back of the wearer.

23. An arm warming device adapted to be worn on one arm of a wearer comprising:

a first tubular sleeve having an upper open end adapted to receive a shoulder of a wearer and a lower open end adapted to terminate proximate a wearer's forearm when the sleeve is positioned on a wearer's arm, said sleeve including a first section for covering an underside of a wearer's arm and a front of a wearer's arm and shoulder and a second section for covering a back side of a wearer's arm and shoulder;

a channel formed in said tubular sleeve along said upper open end; and an endless elastic strap member extending through said channel and emerging from the channel at two spaced locations along the circumferential extent of said upper open end, portions of the strap member extending outwardly therefrom in the form of an elongate loop sized to extend across a wearer's back and around the front of the wearer's arm opposite that wearing the sleeve to secure the device to a wearer's body, and further comprising a second tubular sleeve which is substantially identical to said first tubular sleeve, and wherein said second tubular sleeve is secured to the endless strap member such that said strap member extends through the channel formed in the tubular sleeve and said second tubular sleeve extends outwardly from the elongate loop formed by the elastic strap member.

24. A device according to claim 23, wherein said endless strap member extends through the channels of each of said first and second tubular sleeves such that a first section of said first sleeve and a second section of said second sleeve face substantially the same direction when the elastic strap member is in a substantially uncontorted condition, so that when said elastic strap member is criss-crossed over itself to form an X-shaped configuration, the first sections of each of said first and second sleeves face substantially the same direction.

* * * * *